US006407491B1

(12) United States Patent
Noguchi et al.

(10) Patent No.: US 6,407,491 B1
(45) Date of Patent: Jun. 18, 2002

(54) COLOR CATHODE-RAY TUBE HAVING A DYNAMIC FOCUS VOLTAGE

(75) Inventors: Kazunari Noguchi, Chiba; Shoji Shirai; Yuichi Inoue, both of Mobara, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/381,857

(22) PCT Filed: Mar. 26, 1997

(86) PCT No.: PCT/JP97/01009

§ 371 (c)(1),
(2), (4) Date: Sep. 27, 1999

(87) PCT Pub. No.: WO98/43272

PCT Pub. Date: Oct. 1, 1998

(51) Int. Cl.[7] ..... H01J 29/56; H01J 29/58
(52) U.S. Cl. ..... 313/414; 313/412; 313/447
(58) Field of Search ..... 313/412, 414, 313/447, 448, 449; 315/15, 382.1

(56) References Cited

U.S. PATENT DOCUMENTS 5,600,201 A * 2/1997 Yun et al. ..... 313/414
5,608,284 A * 3/1997 Tojyou et al. ..... 313/414
5,610,481 A * 3/1997 Shirai et al. ..... 313/414
6,184,617 B1 * 2/2001 Choi ..... 313/447
6,339,285 B1 * 1/2002 Yang ..... 313/414

* cited by examiner

*Primary Examiner*—Michael H. Day
(74) *Attorney, Agent, or Firm*—Antonelli, Terry, Stout & Kraus, LLP

(57) ABSTRACT

A cathode-ray tube that has an electron gun including a final-stage main lens made up of a last accelerating electrode and a focusing electrode and having a focus action stronger in horizontal direction than in vertical direction, an electron lens of a first kind formed between the divided focus electrodes and having a focus action stronger in the vertical direction than the horizontal direction to vary the cross sectional shape of an electron beam with an increase of the deflection amount, an electron lens of a second kind formed between the divided focus electrodes for weakening the lens strength with an increase of the deflection amount of an electron beam, and an electron lens of a third kind made up of at least one electrode constituting a three electrode section and having a focus action stronger in the horizontal direction than in the vertical direction. The dynamic focus voltage which decreases with an increasing deflection amount is reduced. The horizontal diameter of an electron beam spot is reduced on the central area of the screen.

16 Claims, 5 Drawing Sheets

COLOR CATHODE-RAY TUBE HAVING A DYNAMIC FOCUS VOLTAGE

BACKGROUND OF THE INVENTION

The present invention relates generally to color cathode-ray tubes for use with color display devices, such as color television sets and computer monitors or the like; and, more particularly, the invention relates to those color cathode-ray tubes having an electron gun assembly with an improved electrode configuration provided inside of the color, cathode-ray tubes.

To enable attainment of a high resolution, while retaining good focus characteristics, over the entire area on the screen faceplate, electron guns for use in cathode-ray tubes, such as Brawn tubes for television sets and Brawn tubes for computer display monitors, are required to optimally control the beam spot shape in accordance with the amount of beam deflection.

One prior known electron gun of this type has been disclosed in, for example, Japanese Patent Laid-Open Hei 04-43532 (1992).

The electron gun as disclosed by the above-identified publication is arranged to include first electrode means for generating a plurality of electron beams and for allowing these electron beams to travel along mutually parallel initial paths on a horizontal plane to reach a screen, and second electrode means constituting a main lens used for focusing each electron beam onto the screen. In this electron gun, a certain focus electrode, selected from among those electrodes making up the main lens and neighboring upon an acceleration electrode with a maximum voltage applied thereto, is subdivided into a plurality of electrode members, wherein the focus electrode comprises an electron lens of a first kind for use in applying a voltage which is variable in synchronism with the deflection of at least one electron beam to thereby cause the electron beam cross-section or profile to change into a non-axial symmetrical shape with an increase in the deflection amount, and the focus electrode also comprises an electron lens of a second kind having a lens intensity that becomes weaker with an increase in deflection amount of the electron beam upon application of a voltage variable in synchronism with the deflection of the electron beam. The main lens, made up of the acceleration electrode and the focus electrode have a focusing action, with respect to the electron beam, which is stronger in the horizontal direction than in the vertical direction.

In the electron gun described above, by subdividing the focus electrode that neighbors the acceleration electrode into a plurality of electrode members and also providing therein at least one electron lens of the first kind for applying to the electrode members a voltage variable in synchronism with the deflection of an electron beam, to thereby cause the profile of such electron beam to change with an increase in the deflection amount into a non-axial symmetrical shape, and, in addition thereto, also providing at least one electron lens of the second kind for applying a voltage variable in synchronism with deflection of the electron beam to thereby weaken its lens intensity with an increase in deflection amount of the electron beam, while employing an arrangement that causes the main lens formed of the acceleration electrode and focus electrode to have its focusing action stronger in the horizontal direction than in the vertical direction, an arrangement is provided wherein the first-kind electron lens will change the profile of the electron beam in a laterally long direction to thereby correct astigmatism due to deflection, while allowing the second-kind electron lens and the main lens to change in lens intensity for correction of the curvature-of-field.

In addition, at the center of the screen, a focus action which is stronger in the horizontal direction than in the vertical direction of the main lens and a focus action which is stronger in the vertical direction than in the horizontal direction of the first-kind electron lens will cancel each other, thus enabling the electron beam to form a nearly circular beam shape.

However, in view of the fact that television sets and display monitors have been experiencing demands for reduced weight and downsizing, as well as low power dissipation or the like in recent years, it should be required in order to reduce the loads of cathode-ray tube drive circuitry to maximally reduce the voltages that increase in potential with an increase in deflection. To this end, the above-noted prior art calls for designing the first-kind electron lens so that its lens intensity is as strong as possible, which would result in the first-kind electron lens forcing the electron beam profile to change to become horizontally longer excessively. Especially, as in large-current regions, an electron beam hitting the main lens can become too large in diameter in the horizontal direction resulting in the electron beam attempting to travel on the outer side of the main lens, the electron beam can receive significant influence from a spherical aberration of the main lens, which in turn causes the horizontal diameter to become larger relative to that in the vertical direction. This results in creation of a problem as to horizontal image resolution reduction which precludes achievement of good image quality.

SUMMARY OF THE INVENTION

It is therefore an object of the present invention to provide a color cathode-ray tube which is capable of suppressing an increase in the horizontal diameter of more than one electron beam emitted from an electron gun to thereby obtain good image quality over the entire area of a display screen.

To attain the foregoing object, the present invention employs a specific arrangement.

A color cathode-ray tube comprises a screen, an electron gun having three cathodes arranged on a single horizontal plane for generation of electron beams, first electrode means including a control electrode and a first acceleration electrode disposed sequentially from the cathodes for causing the electron beams to travel to the screen along initial pathways parallel to each other on the single horizontal plane, and an electron gun having second electrode means including a focus electrode and a final acceleration electrode for forming a main lens for use in focusing the electron beams on the screen picture plane, wherein those electrodes constituting the second electrode means of said electron gun include a focus electrode neighboring upon the final acceleration electrode with a maximum voltage applied thereto and being made up of a plurality of divided electrode members, the cathode-ray tube comprising:

a final-stage main lens formed of said final acceleration electrode and an electrode member neighboring upon this final acceleration electrode for providing a focusing action which is stronger in a horizontal direction than in a vertical direction when all the electrode members constituting said focus electrode as subdivided into a plurality of parts are equal in voltage potential;

at least one electron lens of a first kind formed between said divided focus electrode members for having a focusing action stronger in the vertical direction than in the horizontal direction and for causing the electron beams to change in profile with an increase in deflection amount thereof by applying a voltage potentially variable in synchronism with deflection of the electron beams;

at least one electron lens of a second kind formed between said divided focus electrode members for weakening the lens intensity with an increase in deflection amount of the electron beams by applying thereto a voltage variable in synchronism with deflection of the electron beams; and an electron lens of a third kind formed of at least one electrode constituting the first electrode means of said electron gun for having a focusing action stronger in the horizontal direction than in the vertical direction.

With such an arrangement, the following effect is obtainable.

By providing the third-kind electron lens for longitudinally deforming the electron beam cross-sectional shape or profile as formed between at least one electrode and another electrode adjacent thereto, which are selected from among those electrodes making up the first electrode means, it becomes possible to suppress an excessive horizontal expansion of more than one electron beam due to action of the first-kind electron lens, which in turn makes it possible to reduce the spherical aberration in the horizontal direction that the electron might receive in the main lens. As a result, it is possible to downsize or miniaturize the horizontal diameter of an electron beam spot at the center of the display screen, thereby enabling achievement of excellent image quality over the entire screen area.

DETAILED DESCRIPTION OF THE PREFERRED EMBODIMENTS

Some preferred embodiments of the present invention will be explained in detail with reference to the accompanying drawings.

Figure 1:
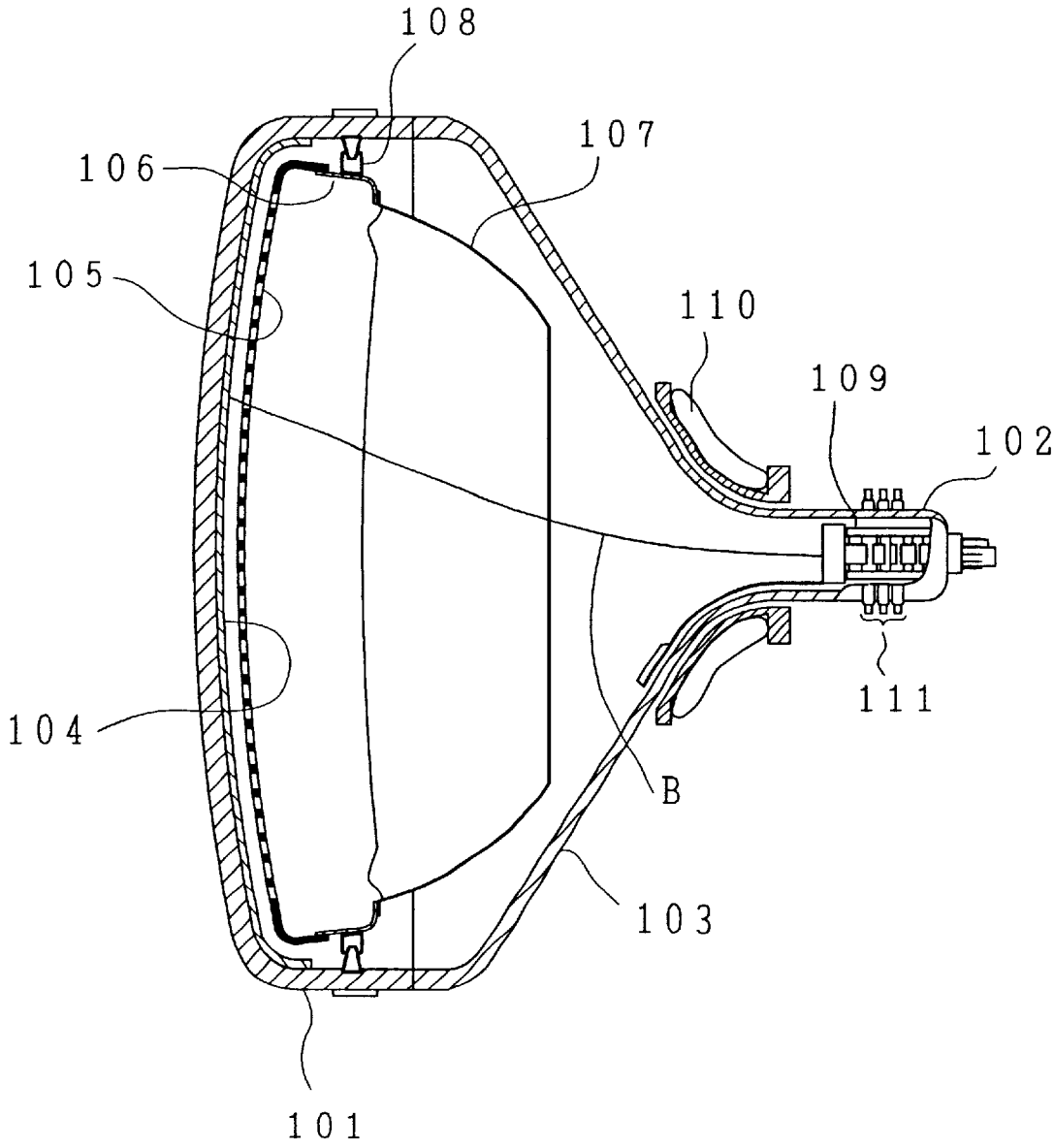
FIG. 1 is a cross-sectional diagram along the tube axis showing a color cathode-ray tube in accordance with the present invention.

FIG. 1 is a sectional diagram along the tube axis of a color cathode-ray tube in accordance with one embodiment of the present invention, wherein reference numeral. 101 designates a panel portion that constitutes a screen faceplate; 102 denotes a neck portion containing therein an electron gun assembly; 103 indicates a funnel portion for coupling-together the panel portion and the neck portion; 104 shows a fluorescent film as formed on the inner surface of the panel portion for constituting a screen image plane; 105 denotes a shadow mask disposed at an opposing and adjacent the fluorescent film; 106 denotes a mask frame for holding or supporting the shadow mask; 107 denotes an internal magnetic shield which is machined into a prespecified shape along the inner wall of the funnel portion for shielding external magnetic fields; 108 denotes a suspension spring for attachment of the mask frame holding the shadow mask to the panel portion; 109 denotes an electron gun for emission of electron beams; 110 denotes a deflection yoke for scanning the electron beams on the fluorescent film; 111 denotes a magnet for correction of miss-convergence (color deviation) and/or color purity (color pureness); and B denotes three in-line electron beams.

The color cathode-ray tube of this type constitutes a vacuum outer envelope made up of the panel portion 101 having the screen image plane with the fluorescent film 104 formed on its inner surface and the neck portion 102 which houses the electron gun, as well as the funnel portion 103 coupling said panel portion and neck portion together.

The electron gun 109 contained in said neck portion 102 emits three electron beams B having an in-line layout, which extend in one plane, toward the phosphor film 104.

The deflection yoke 110 that is externally mounted on said vacuum outer envelope in its transitional region between the funnel portion 103 and the neck portion 102 is operable to deflect the three in-line electron beams as emitted from the electron gun 109 in both the horizontal and vertical directions for allowing the electron beams, color-selected by the shadow mask 105, to impinge on the phosphor film 104, thus forming color images.

It should be noted that the shadow mask 105 is welded to the mask frame 106 and the suspension spring 108, which is secured to part of the outer periphery of the mask frame 106 engages with more than one panel pin embedded in the inside wall of the panel portion 101 so that the shadow mask is attached relative to the phosphor film 104 with a prespecified distance defined therebetween.

Figure 2:
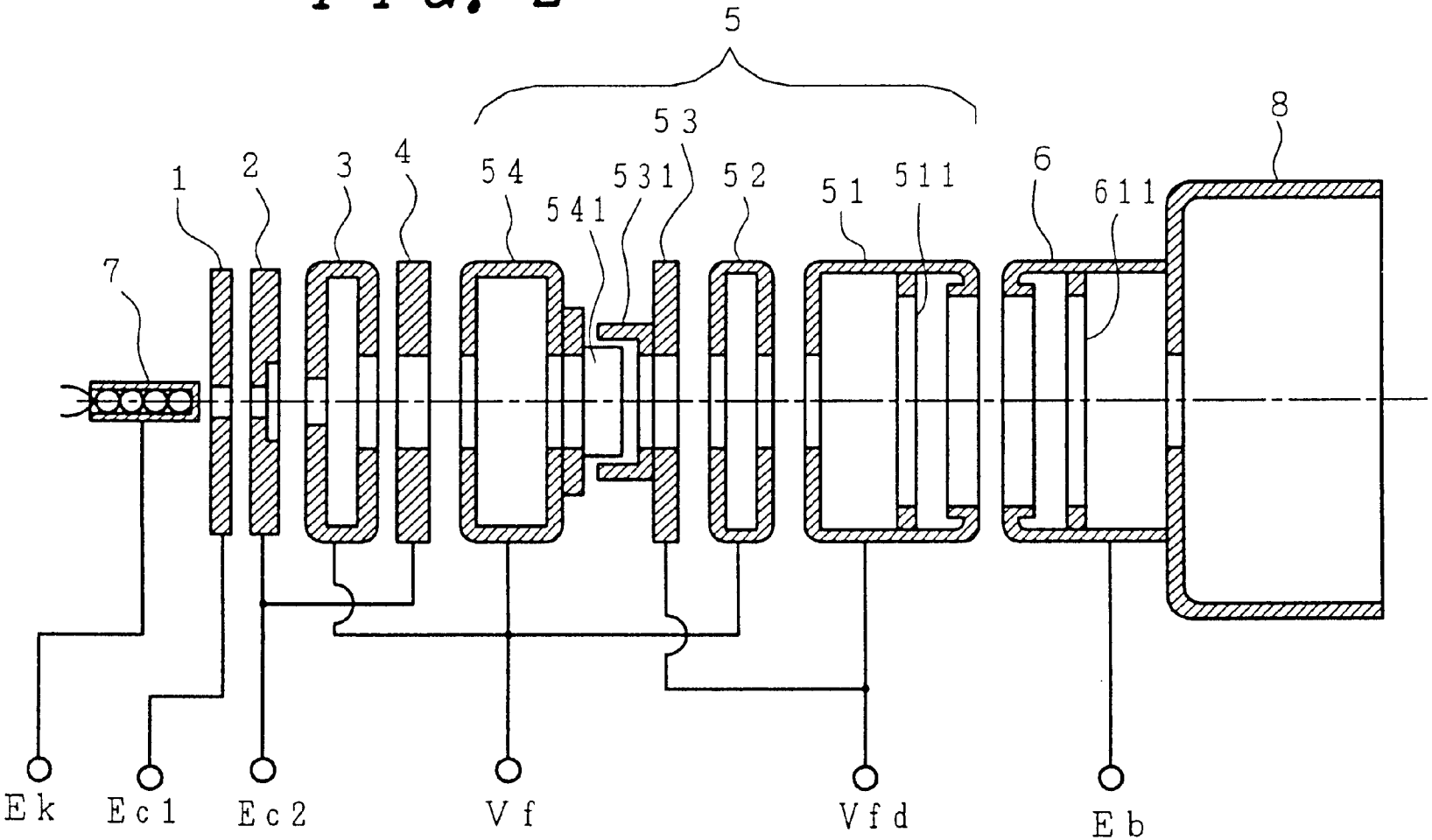
FIG. 2 an axial sectional diagram of an electron gun of the in-line type having three electron beams representing one embodiment of the electron gun as used in the color cathode-ray tube of the present invention.

FIG. 2 shows a cross-section along the axis direction of the in-line electron gun having three electron beams representing one embodiment of the electron gun that is employed in the color cathode-ray tube embodying the present invention, wherein numeral 1 designates a first electrode (control electrode); 2 denotes a second electrode (first acceleration electrode); 3 denotes a third electrode (first focus electrode); 4 denotes a fourth electrode (second acceleration electrode); 5 denotes a fifth electrode (second focus electrode); 6 denotes a sixth electrode (final acceleration electrode); 7 denotes a cathode; and 8 denotes a shield electrode. In addition, the fifth electrode 5 is subdivided into four separate electrode members, wherein 51 indicates a first member of the fifth electrode; 52 shows a second member of the fifth electrode; 53 denotes a third member of the fifth electrode; and 54 denotes a fourth member of the fifth electrode. Further, 511 denotes an astigmatism correction electrode plate as provided inside of the first member 51 of the fifth electrode, whereas 611 denotes an astigmatism correction electrode plate disposed inside of the sixth electrode 6.

In FIG. 2, the cathode 7 and the first electrode 1 plus the second electrode 2 make up a first electrode means (triode unit), whereas the third electrode 3 and fourth electrode 4, plus the fifth electrode 5, as well as the sixth electrode 6, constitute a second electrode means (main lens unit). A maximum voltage Eb is applied to the sixth electrode 6, wherein this sixth electrode 6 and the opposite plane of the first member 51 of the fifth electrode form a final-stage main lens. This final-stage main lens has a focusing action or operability, with respect to the electron beams, which is stronger in the horizontal direction than in the vertical direction.

The third member 53 of the fifth electrode is configured such that three circular electron beam passing holes are formed in the opposite plane associated with the fourth member 54 of the fifth electrode, wherein horizontal planar electrodes 531 extending in the direction of the fourth member 54 of the fifth electrode are provided at up and down locations in the vertical direction of the electron beam passing holes; and the fourth member 54 of the fifth electrode is configured such that three circular electron beam passing holes are formed in the opposite plane associated with the third member 53 of the fifth electrode, wherein vertical planar electrodes 541 extending in the direction of the third member 53 of the fifth electrode are provided at right and left locations in the horizontal direction of each of the electron beam passing holes for permitting formation of the electron lens of the first kind at this portion.

In addition, three circular electron beam passing holes are formed in respective opposite planes of the first member 51 of the fifth electrode and second member 52 of the fifth electrode plus the third member 53 of the fifth electrode for formation of an electron lens of the second kind at this part.

A dynamic focus voltage Vfd, which increases with an increase in the deflection amount of the electron beams, is applied to the first member 51 of the fifth electrode and the third member 53 of the fifth electrode; while, to the second member 52 of the fifth electrode and the fourth member 54 of the fifth electrode plus the third electrode 3, there is applied a constant focus voltage Vf that is relatively higher than the dynamic focus voltage Vfd. In view of the fact that the dynamic focus voltage Vfd is relatively lower than the focus Vf, the first-kind electron lens subjects the electron beams to a focusing action which is stronger in the vertical direction than in the horizontal direction, while the second-kind electron lens subjects the electron beams to a focusing action. These two electron lens' focusing actions reach a maximum at the time of no electron beam deflection, that is, at the center of the display screen, and will reach a minimum when deflecting toward the periphery of the screen.

Further, a screen voltage Ec2 that is the same as that of the second electrode 2 is applied to the fourth electrode 4 for formation of a pre-stage of the main lens between the third electrode 3 and the fourth member 54 of the fifth electrode.

And, the second electrode 2 is constructed such that three circular electron beam passing holes are formed in its opposite plane relative to the third electrode 3, wherein a slit is provided around each hole in the in-line direction, which slit has a diameter, as measured in a direction perpendicular to the in-line direction, which is greater than the diameter in the in-line direction; and, the third electrode 3 has three circular electron beam passing holes formed in its opposite plane relative to the second electrode 2 for formation of an electron lens of the third kind at this part. The third-kind electron lens subjects the electron beams to a focusing action stronger in the horizontal direction than in the vertical direction.

Accordingly, in the structure thus arranged, modifying the shape of the holes of those electrodes making up the third-kind electron lens along with the shape of the outlying portions of such holes permits adequate adjustment of the balance of the vertical and horizontal focusing actions of the third-kind electron lens, thereby causing the electron beams leaving the cathode 7 to be reduced in horizontal diameter at the third-kind electron lens so that they arrive at the first-kind electron lens with an appropriate vertically elongated shape. And, the first-kind electron lens gives such electron beams a vertically stronger focusing action at the center of the screen. Next, the second-kind electron lens subjects the electron beams to a focusing action. And, the electron beams that have now a laterally longer shape reach the final-stage main lens and then receive a horizontal focusing action from the final-stage main lens. At this time, appropriately designing the size of the slit of the second electrode 2 makes it possible to adjust the horizontal focusing action given by the third-kind electron lens to the electron beams. In this way, it is possible to suppress excessive horizontal expansion of such electron beams due to the first-kind electron lens, which in turn enables suppression of spherical aberration in the horizontal direction of the final-stage main lens. As a result, it becomes possible to make the horizontal diameter of the electron beams smaller at the center of the screen, which in turn makes it possible to obtain the intended electron beam spots that are approximately equal in horizontal diameter and vertical diameter.

Figure 3:
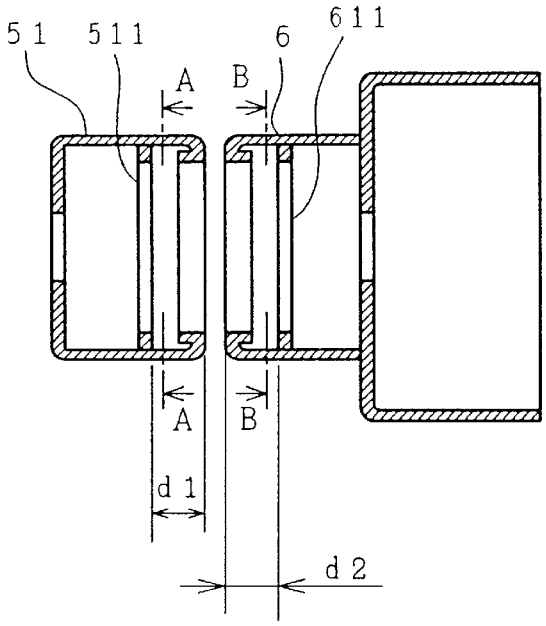
FIG. 3 is vertical sectional diagram of a main part of a main lens unit in one embodiment of the electron gun used in the color cathode-ray tube of the present invention.
Figure 4A:
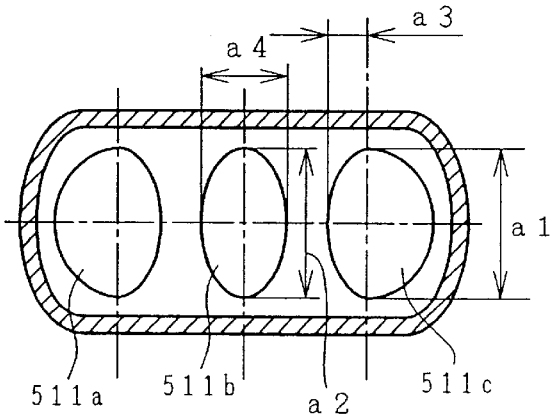
FIG. 4(*a*) is a sectional view taken along line A—A of FIG. 3, whereas FIG. 4(*b*) is a sectional view taken along line B—B of FIG. 3.
Figure 4B:
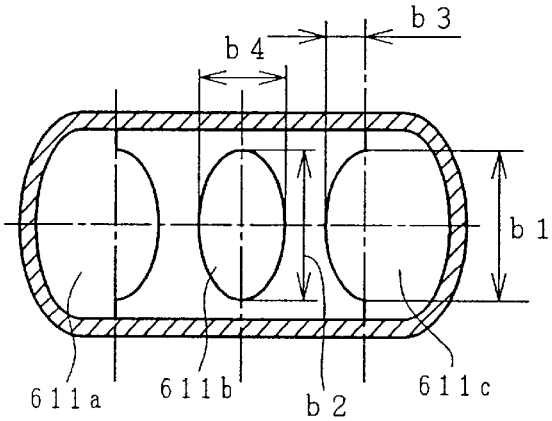

FIG. 3 is a vertical sectional diagram of one exemplary configuration of the main lens unit in one-embodiment of the electron gun used in the color cathode-ray tube in accordance with present invention; FIG. 4(*a*) depicts a sectional view taken along line A—A in FIG. 3, whereas FIG. 4(*b*) is a sectional view taken along line B—B in FIG. 3.

In FIG. 3 and FIG. 4, an astigmatism correction electrode 511 disposed at the first element 51 of the fifth electrode has an electron beam passing hole 511*b* for permitting the center beam to pass therethrough along with electron beam passing holes 511*a*, 511*c* for permitting penetration of outside beams, while an astigmatism correction electrode 611 disposed at the sixth electrode member 6 has an electron beam passing hole 611*b* for permitting the center beam to pass therethrough along with electron beam passing holes 611*a*, 611 for permitting penetration of the outside beams, all of which holes being formed in the in-line direction.

These electron beam passing holes 511*a*, 511*b*, 511*c*, 611*a*, 611*b*, 611*c* are each of approximately elliptical shape having the long axis in the vertical direction, or alternatively a combined shape of nearly a semi-ellipse and half-circle, or still alternatively a cutaway shape of nearly a semi-ellipse, wherein the single-openings of the first member 51 of the fifth electrode and the sixth electrode 6 which oppose each other are identical in shape and size.

In the structure described above, it is possible to produce a stronger vertical focusing action and horizontal focusing action by designing at predetermined sizes the from-the-endface retardation amount d1 of the first member 51 of the fifth electrode (second focus electrode) opposing the sixth electrode 6 (final acceleration electrode) of the astigmatism correction electrode 511, the from-the-endface retardation amount d2 of the sixth electrode 6 (final acceleration electrode) opposing the first member 51 of the fifth electrode (second focus electrode) of the astigmatism correction electrode 611, the inside horizontal diameter a3 and vertical diameter al of the opening holes 511*a*, 511*c*, the horizontal diameter a4 and vertical diameter a2 of the opening hole 511*b*, the inside horizontal diameter b3 and vertical diameter b1 of the opening holes 611*a*, 611*c*, and the horizontal diameter b4 and vertical diameter b2 of the opening hole 611*b*.

Figure 5B:
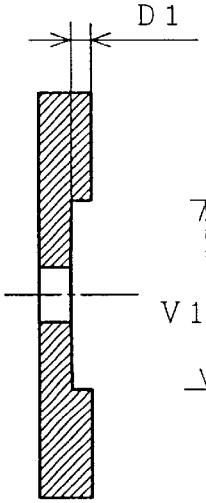
FIGS. 5(*a*) and 5(*b*) show an exemplary configuration of a second electrode (first acceleration electrode) in one embodiment of the electron gun used in the color cathode-ray tube of the present invention, wherein FIG. 5(*a*) is a front view as seen from the side of a third electrode (first focus electrode), and FIG. 5(*b*) is a sectional view taken along line C—C in FIG. 5(*a*).
Figure 5A:
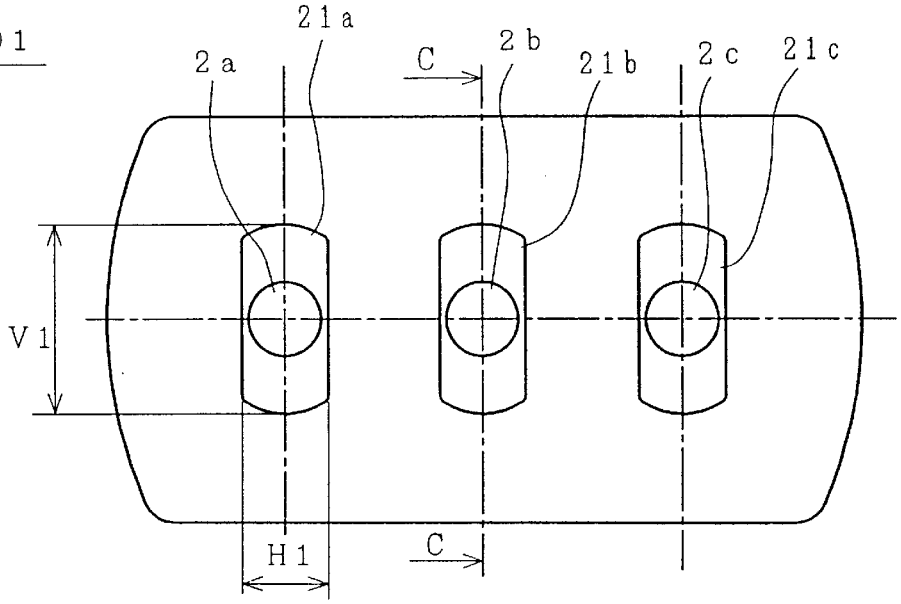

FIGS. 5(*a*) and 5(*b*) illustrate an exemplary configuration of the second electrode (first acceleration electrode) in the electron gun used in the color cathode-ray tube of the present invention, wherein FIG. 5(*a*) is a front view as seen from the third electrode (first focus electrode) side, whereas FIG. 5(*b*) is a sectional diagram taken along line C—C in FIG. 5(*a*). Reference characters 2*a*, 2*b*, 2*c* designate circular electron beam passing holes; 21*a*, 21*b*, 21*c* denote slits as provided in the areas surrounding the electron beam passing holes 2*a*, 2*b*, 2*c*. In this structure it is possible by designing the horizontal diameter H1 and vertical diameter V1, plus the depth D1, of the openings of the slits 21*a*, 21*b*, 21*c* at prespecified sizes to form an electron lens that can subject the electron beams to a focusing action which is stronger in the horizontal direction than in the vertical direction.

Figure 6A:
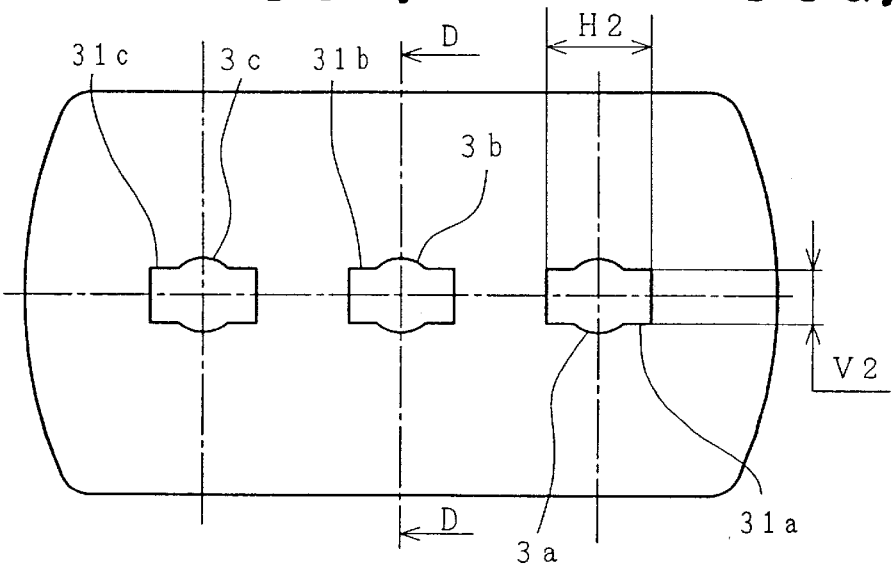
FIGS. 6(*a*) and 6(*b*) show of an exemplary configuration of a third electrode (first acceleration electrode) in one embodiment of the electron gun used in the color cathode-ray tube of the present invention, wherein FIG. 6(*a*) is a front view as seen from the side of the second electrode (first acceleration electrode), and FIG. 6(*b*) is a sectional view taken along line D—D in FIG. 6(*a*).
Figure 6B:
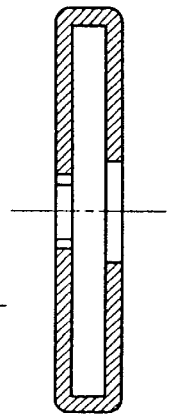

Additionally, FIGS. 6(*a*) and 6(*b*) illustrate an exemplary configuration of the third electrode (first focus electrode) in the electron gun used in the color cathode-ray tube of the present invention, wherein FIG. 6(*a*) is a front view as seen from the second electrode (first acceleration electrode) side, whereas FIG. 6(*b*) is a sectional diagram taken along line D—D in FIG. 6(*a*). Reference characters 3*a*, 3*b*, 3*c* designate electron beam passing holes; 31*a*, 31*b*, 31*c* denote slits formed horizontally through the electron beam passing holes 3*a*, 3*b*, 3*c*. In this structure, it is possible by designing the horizontal diameter H2 and vertical diameter V2 of openings of the slits 31*a*, 31*b*, 31*c* at preselected sizes to form an electron lens that can subject the electron beams to a focusing action which is stronger in the horizontal direction than in the vertical direction.

It is to be noted that the electrodes of FIG. 5(*a*), FIG. 6(*a*) are employable either alone or in combination. Further, note that the electrode shape should not be limited only to the embodiments described above, and that similar effects and advantages are offerable by letting the shape of outlying part of a hole, including the holes per se, be of appropriate non-axial symmetrical shapes, such as designing the hole shape into a non-axial symmetrical shape.

Figure 7:
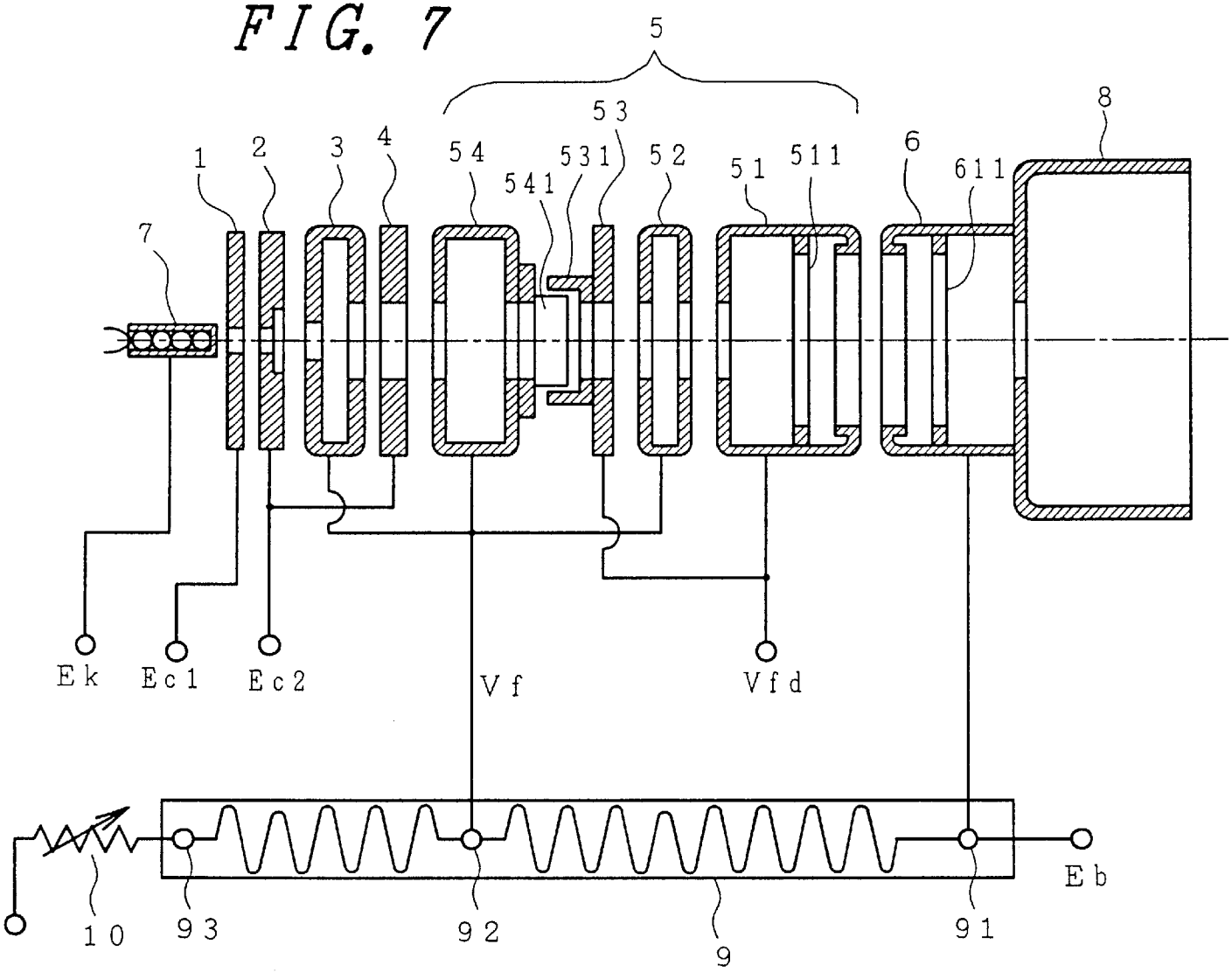
FIG. 7 is axial sectional diagram of an in-line electron gun having three electron beams, representing another embodiment of the electron gun used in the color cathode-ray tube of the present invention.

FIG. 7 is a pictorial sectional diagram in the axis direction of an in-line electron gun having three electron beams and representing another embodiment of the electron gun used in the color cathode-ray tube in accordance with the present invention, wherein reference numeral 9 designates an internal resistance built in the cathode-ray tube, and 10 indicates a variable resistor as provided outside of the cathode-ray tube for adjustment, the remaining part of the electrode arrangement being similar to that shown in FIG. 2. The internal built-in resistor 9 is of a high resistance ranging from 1 to 2 GΩ, more or less, wherein three terminals are output in such a way that a terminal 91 is connected to the sixth electrode 6 while an anode voltage Eb is applied thereto, a terminal 92 provided at a midway portion is connected to the second member 52 of the fifth electrode and the fourth member 54 of the fifth electrode plus the third electrode 3 with a constant focus voltage Vf being supplied to each electrode, and that a terminal 93 is connected via a stem pin to the external variable resistor 10.

With such an arrangement, since the focus voltage Vf is no longer required to be supplied from the stem pin and is supplied by voltage division schemes from the built-in resistor 9, the high voltage required to have several kV is limited only to the dynamic focus voltage Vfd, that will increase in potential with an increase in the deflection amount of the electron beams, which in turn makes it possible in the case of cathode-ray tubes, such as Brawn tubes for television receivers or Brawn tubes for display monitors or the like, to obtain the intended characteristics similar to those in the embodiment of FIG. 2 without calling for any special stems and sockets for voltage supplement and other purposes.

According to the color cathode-ray tubes of the above embodiments, it is possible to obtain high-resolution images over the entire area of the display screen.

It must be noted that the present invention should not be limited to the aforesaid embodiments only and may be similarly applied to color cathode-ray tubes with various types of electron guns of other kinds and also to other cathode-ray tubes.

As apparent from the foregoing, the color cathode-ray tube in accordance with the present invention is adaptable for use with large-screen color television sets with excellent image quality and high resolution and also high-precision color display monitor units.

What is claimed is:

1. A color cathode-ray tube comprising a screen, three cathodes laid out on a single horizontal plane for generation of electron beams, first electrode means including a control electrode and a first acceleration electrode disposed sequentially from the cathodes for causing the electron beams to travel to the screen along initial pathways parallel to each other on the single horizontal plane, and an electron gun having second electrode means including a focus electrode portion and a final acceleration electrode for forming a main lens for use in focusing the electron beams on the screen, characterized in that those electrodes constituting the second electrode means of said electron gun includes a focus electrode of said focus electrode portion neighboring upon the final acceleration electrode with a maximal voltage applied thereto and being made up of a plurality of divided focus electrode members, and by comprising:

a final-stage of said main lens being formed of said final acceleration electrode and an electrode member of said divided focus electrode members neighboring the final acceleration electrode for providing a focusing action which is stronger in a horizontal direction than in a vertical direction, with all of the divided focus electrode members constituting said focus electrode being equal in voltage potential;

at least one electron lens of a first kind formed between said divided focus electrode members for providing a focusing action stronger in the vertical direction than in the horizontal direction and for causing the electron beams to change in profile with an increase in deflection amount thereof by applying a voltage potentially variable in synchronism with deflection of the electron beams;

at least one electron lens of a second kind formed between said divided focus electrode members for weakening the lens intensity with an increase in deflection amount of the electron beams by applying a voltage variable in synchronism with deflection of the electron beams; and an electron lens of a third kind formed of at least one electrode constituting the first electrode means of said electron gun for having a focusing action stronger in the horizontal direction than in the vertical direction.

2. A color cathode-ray tube as recited in claim 1, characterized in that at least one electrode member of the focus electrode forming said electron lens of the first kind is electrically connected to at least one electrode member within the focus electrode forming said electron lens of the second kind.

3. A color cathode-ray tube as recited in claim 1, characterized by applying a voltage variable in synchronism with deflection of the electron beams to either one of the electrode members of the focus electrode forming said electron lens of the first kind while applying a constant voltage to the other electrode member within the focus electrode forming said electron lens of the first kind, wherein the voltages are set to satisfy the relationship $Vfd \leqq Vf$, where Vfd is the voltage variable in synchronism with deflection of the electron beams and Vf is said constant voltage.

4. A color cathode-ray tube as recited in claim 1, characterized in that the electrodes forming said electron lens of the third kind includes said first acceleration electrode.

5. A color cathode-ray tube as recited in claim 4, characterized in that the electrodes forming said electron lens of the third kind is said first acceleration electrode and an electrode adjacent to this first acceleration electrode on the screen side.

6. A color cathode-ray tube as recited in claim 5, characterized in that the electrode adjacent to said first acceleration electrode on the screen side provides on the first acceleration electrode side thereof a slit opening longer in the horizontal direction than in the vertical direction.

7. A color cathode-ray tube as recited in claim 4, characterized in that said first acceleration electrode provides on the screen side thereof a slit opening longer in the vertical direction than in the horizontal direction.

8. A color cathode-ray tube as recited in claim 1, characterized in that said first acceleration electrode of said first electrode means forms a part of said electron lens of the third kind and is configured so that electron beams after passing therethrough have a vertically elongated shape.

9. A color cathode-ray tube comprising a screen, three cathodes laid out on a single horizontal plane for generation of electron beams, first electrode means including a control electrode and a first acceleration electrode disposed sequentially from the cathodes for causing the electron beams to travel to the screen along initial pathways parallel to each other on the single horizontal plane, and an electron gun having second electrode means including a focus electrode portion and a final acceleration electrode for forming a main lens for use in focusing the electron beams on the screen, characterized in that those electrodes constituting the second electrode means of said electron gun includes a focus electrode of said focus electrode portion neighboring upon the final acceleration electrode with a maximal voltage applied thereto and being made up of a plurality of divided focus electrode members, and by comprising:

a final-stage of the main lens being formed of said final acceleration electrode and an electrode member of said divided focus electrode members neighboring the final acceleration electrode for providing a focusing action which is stronger in a horizontal direction than in a vertical direction, with all of the divided focus electrode members constituting said focus electrode being equal in voltage potential;

at least one electron lens of a first kind formed between said divided focus electrode members for providing a focusing action stronger in the vertical direction than in the horizontal direction and for causing the electron beams to change in profile with an increase in deflection amount thereof by applying a voltage potentially variable in synchronism with deflection of the electron beams;

at least one electron lens of a second kind formed between said divided focus electrode members and said election lens of the second kind also formed between said final-stage of said main lens and said electron lens of the first kind for weakening the lens intensity with an increase in deflection amount of the electron beams by applying a voltage variable in synchronism with deflection of the electron beams; and an electron lens of a third kind formed of at least one electrode constituting the first electrode means of said electron gun for having a focusing action stronger in the horizontal direction than in the vertical direction.

10. A color cathode-ray tube as recited in claim 9, characterized in that at least one electrode member of the focus electrode forming said electron lens of the first kind is electrically connected to at least one electrode member within the focus electrode forming said electron lens of the second kind.

11. A color cathode-ray tube as recited in claim 9, characterized by applying a voltage variable in synchronism with deflection of the electron beams to either one of the electrode members of the focus electrode forming said electron lens of the first kind while applying a constant voltage to the other electrode member within the focus electrode forming said electron lens of the first kind, wherein the voltages are set to satisfy the relationship $Vfd \leqq Vf$, where Vfd is the voltage variable in synchronism with deflection of the electron beams and Vf is said constant voltage.

12. A color cathode-ray tube as recited in claim 9, characterized in that the electrodes forming said electron lens of the third kind includes said first acceleration electrode.

13. A color cathode-ray tube as recited in claim 12, characterized in that the electrodes forming said electron lens of the third kind is said first acceleration electrode and an electrode adjacent to this first acceleration electrode on the screen side.

14. A color cathode-ray tube as recited in claim 13, characterized in that the electrode adjacent to said first acceleration electrode on the screen side provides on the first acceleration electrode side thereof a slit opening longer in the horizontal direction than in the vertical direction.

15. A color. cathode-ray tube as, recited in claim 12, characterized in that said first acceleration electrode provides on the screen side thereof a slit opening longer in the vertical direction than in the horizontal direction.

16. A color cathode-ray tube as recited in claim 9, characterized in that said first acceleration electrode of said first electrode means forms a part of said electron lens of the third kind and is configured so that electron beams after passing therethrough have a vertically elongated shape.

* * * * *